US007474197B2

(12) United States Patent
Choi et al.

(10) Patent No.: US 7,474,197 B2
(45) Date of Patent: Jan. 6, 2009

(54) AUDIO GENERATING METHOD AND APPARATUS BASED ON MOTION

(75) Inventors: Eun-seok Choi, Anyang-si (KR); Dong-yoon Kim, Seoul (KR); Jong-koo Oh, Yongin-si (KR); Won-chul Bang, Seongnam-si (KR); Joon-kee Cho, Yongin-si (KR); Sung-jung Cho, Suwon-si (KR); Wook Chang, Seoul (KR); Kyoung-ho Kang, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 284 days.

(21) Appl. No.: 11/043,186

(22) Filed: Jan. 27, 2005

(65) Prior Publication Data

US 2005/0213476 A1 Sep. 29, 2005

(30) Foreign Application Priority Data

Mar. 26, 2004 (KR) ..... 10-2004-0020763

(51) Int. Cl.
*G08B 3/10* (2006.01)

(52) U.S. Cl. ..... 340/384.7; 340/384.1; 340/573.1; 84/602; 446/397

(58) Field of Classification Search ..... 340/384.7
See application file for complete search history.

(56) References Cited

U.S. PATENT DOCUMENTS 4,904,222 A * 2/1990 Gastgeb et al. ..... 446/405
4,905,560 A * 3/1990 Suzuki et al. ..... 84/600
5,058,480 A * 10/1991 Suzuki et al. ..... 84/600
5,170,002 A * 12/1992 Suzuki et al. ..... 84/600
5,177,311 A * 1/1993 Suzuki et al. ..... 84/600
5,192,823 A * 3/1993 Suzuki et al. ..... 84/600
5,290,964 A * 3/1994 Hiyoshi et al. ..... 84/600
5,338,891 A * 8/1994 Masubuchi et al. ..... 84/600
5,920,024 A * 7/1999 Moore ..... 84/609
6,150,947 A * 11/2000 Shima ..... 340/692
6,626,728 B2 * 9/2003 Holt ..... 446/219
6,826,509 B2 * 11/2004 Crisco et al. ..... 702/141

(Continued)

FOREIGN PATENT DOCUMENTS

JP 11-118507 4/1999

(Continued)

*Primary Examiner*—George A Bugg
*Assistant Examiner*—Eric M Blount
(74) *Attorney, Agent, or Firm*—Sughrue Mion, PLLC

(57) ABSTRACT

An audio generating apparatus includes: a sensor which senses a motion of a predetermined apparatus and generates a sensor signal corresponding to the sensed motion; a motion pattern recognizer which recognizes a motion pattern of the predetermined apparatus based on the sensor signal; and an audio signal generator which generates an audio signal corresponding to the motion pattern. The motion pattern recognizer includes: an analog-to-digital converter which converts the sensor signal into a digital sensor signal; and a motion pattern analyzer which analyzes the motion pattern of the predetermined apparatus based on the digital sensor signal. The audio signal generator includes: a storage medium which stores the motion pattern of the predetermined apparatus and audio signal data corresponding to the motion pattern; and a signal generator which extracts the audio signal data from the storage medium to generate the audio signal.

17 Claims, 8 Drawing Sheets

U.S. PATENT DOCUMENTS 6,897,779 B2 * 5/2005 Nishitani et al. ..... 340/573.1
D509,257 S * 9/2005 Yamamoto ..... D21/398
7,028,547 B2 * 4/2006 Shiratori et al. ..... 73/495

FOREIGN PATENT DOCUMENTS

JP 2000-148351 5/2000
JP 2003-076368 3/2003
KR 2003-0004387 A 1/2003

* cited by examiner

AUDIO GENERATING METHOD AND APPARATUS BASED ON MOTION

BACKGROUND OF THE INVENTION

This application claims priority from Korean Patent Application No. 2004-20763, filed on Mar. 26, 2004 in the Korean Intellectual Property Office, the disclosure of which is incorporated herein in its entirety by reference.

FIELD OF THE INVENTION

The present invention relates to an audio generating method and apparatus, and more particularly, to a motion-based audio generating apparatus and method for recognizing a motion pattern of a predetermined apparatus using an inertia sensor and generating audio corresponding to the motion pattern.

DESCRIPTION OF THE RELATED ART

Angular velocity sensors sense angular variation of a predetermined apparatus and output a sensor signal value corresponding to the angular variation. Acceleration sensors sense a velocity variation of a predetermined apparatus and output a sensor signal value corresponding to the velocity variation. Studies have been made of an input apparatus which recognizes a motion pattern of a predetermined apparatus over a 3-dimensional space using an inertia sensor such as an angular velocity sensor and an acceleration sensor and inputs a character, a symbol, or a predetermined control command corresponding to the motion pattern.

Motion patterns of users are slightly different from one another. Thus, in a case where a user does not move in an accurate motion pattern, a character or a control command that is not intended by the user may be input to the motion-based input apparatus. In the motion-based input apparatus, the user cannot recognize during input of a specific character or a control command what kind of character or control command the user inputs. After the user completely inputs the specific character or the control command, the user may recognize via an input or control result corresponding to an input motion of the input apparatus what kind of character or control command the user has input. Thus, when a user's desired character or control command is not input, a predetermined character or control command should be re-input from the beginning.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

According to an aspect of the present invention, there is provided a motion-based audio generating method and apparatus for recognizing a motion pattern of a predetermined apparatus and generating predetermined audio corresponding to the motion pattern.

According to an aspect of the present invention, there is provided a computer-readable recording medium on which a program is recorded to execute the motion-based audio generating method in a computer.

According to an aspect of the present invention, there is provided a motion-based audio generating apparatus including: a sensor which senses a motion of a predetermined apparatus and generates a sensor signal corresponding to the sensed motion; a motion pattern recognizer which recognizes a motion pattern of the predetermined apparatus based on the sensor signal; and an audio signal generator which generates an audio signal corresponding to the motion pattern.

The motion pattern recognizer may include: an analog-to-digital converter which converts the analog sensor signal into a digital sensor signal; and a motion pattern analyzer which analyzes the motion pattern of the predetermined apparatus based on the digital sensor signal.

The audio signal generator may include: a storage medium which stores the motion pattern of the predetermined apparatus and audio signal data corresponding to the motion pattern; and a signal generator which extracts the audio signal data from the storage medium to generate the audio signal.

The motion-based audio generating apparatus may further include an output unit which outputs the audio signal.

The sensor may be an angular velocity sensor, an acceleration sensor, or a combination of the angular velocity sensor and the acceleration sensor.

According to another aspect of the present invention, there is provided a motion-based audio generating method including: sensing a motion of a predetermined apparatus and generating a sensor signal corresponding to the sensed motion; recognizing a motion pattern of the predetermined apparatus based on the sensor signal; and generating an audio signal corresponding to the motion pattern.

The recognition of the motion pattern may include: converting the analog sensor signal into a digital sensor signal; and analyzing the motion pattern of the predetermined apparatus based on the digital sensor signal.

The analysis of the motion pattern of the predetermined apparatus may include: initializing a motion pattern recognition indication parameter; detecting a time when the sensor signal exceeds a predetermined threshold value; and setting the motion pattern recognition indication parameter to a predetermined value at detected time when the sensor signal exceeds the predetermined threshold value.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF ILLUSTRATIVE, NON-LIMITING EMBODIMENTS OF THE PRESENT INVENTION

Hereinafter, an audio generating apparatus and method, according to the present invention, will be described with reference to the attached drawings.

Figure 1:
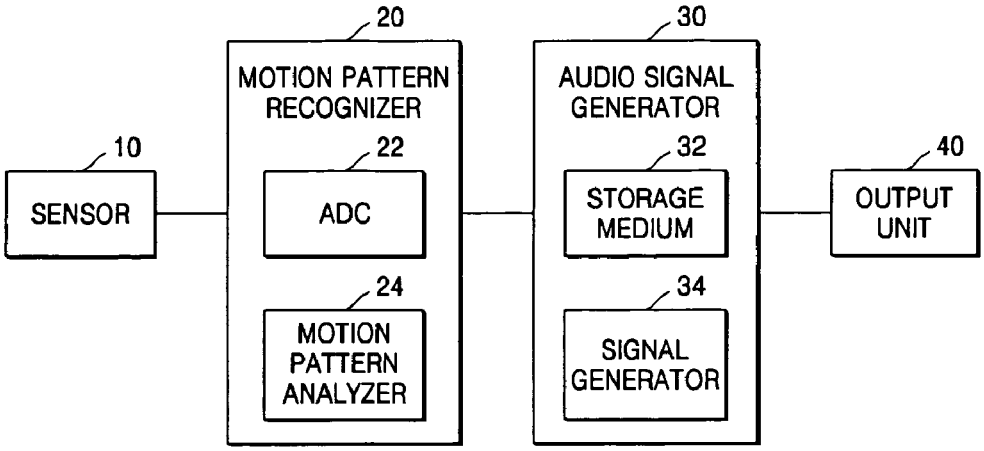
FIG. 1 is a block diagram of a motion-based audio generating apparatus, according to an exemplary embodiment of the present invention.

FIG. 1 is a block diagram of a motion-based audio generating apparatus, according to an exemplary embodiment of the present invention. Referring to FIG. 1, the motion-based audio generating apparatus includes a sensor 10, a motion pattern recognizer 20, an audio signal generator 30, and an output unit 40. When the motion-based audio generating apparatus moves, the sensor 10 senses the motion of the motion-based audio generating apparatus and outputs a sensor signal value corresponding to the sensed motion. The motion pattern recognizer 20 recognizes a motion pattern of the motion-based audio generating apparatus based on the sensor signal value output from the sensor 10. The audio signal generator 30 generates an audio signal corresponding to the motion pattern of the motion-based audio generating apparatus. The output unit 40 receives the audio signal and outputs audio corresponding to the audio signal. For example, the output unit 40 may include one or more speakers according to an application field of the present invention.

The sensor 10 may include an angular velocity sensor, an acceleration sensor, or a combination of the angular velocity sensor and the acceleration sensor according to the application field of the present invention. Hereinafter, it is defined that an angular velocity and an acceleration of the motion-based audio generating apparatus vary with the motion of the motion-based audio generating apparatus and the motion pattern of the motion-based audio generating apparatus includes variation patterns of the angular velocity and the acceleration. The angular velocity sensor senses the angular velocity of the motion-based audio generating apparatus, i.e., whether the motion-based audio generating apparatus moves to the left and right, up and down, or clockwise and counterclockwise, and generates a sensor signal value corresponding to the sensed angular velocity. The angular velocity sensor may recognize the angular velocity of the motion-based audio generating apparatus. The acceleration sensor senses the acceleration of the motion-based audio generating apparatus, i.e., a change in the motion velocity of the motion-based audio generating apparatus, and generates a sensor signal value corresponding to the sense acceleration. The acceleration sensor may recognize the acceleration of the motion-based audio generating apparatus. In a case where the sensor 10 includes the combination of the angular velocity sensor and the acceleration sensor, the sensor 10 senses the angular velocity and the acceleration of the motion-based audio generating apparatus and generates sensor signal values corresponding to the sensed angular velocity and acceleration.

Figure 2:
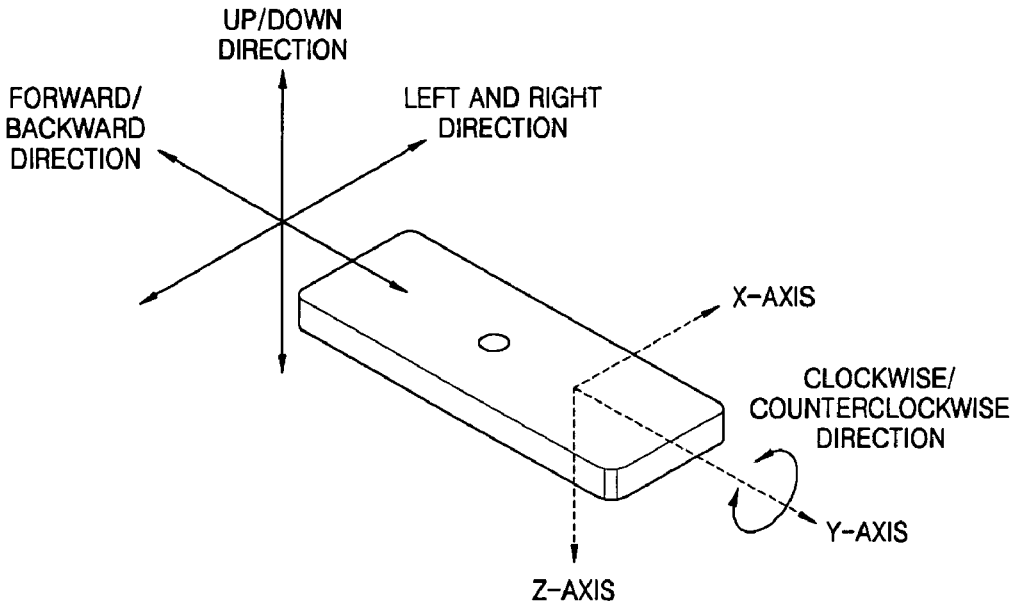
FIG. 2 is a view for showing a motion pattern of the motion-based audio generating apparatus of FIG. 1 used over a 3-dimensional space.

FIG. 2 is a view for showing a motion pattern of the motion-based audio generating apparatus of FIG. 1 used over a 3-dimensional space. As shown in FIG. 2, the motion-based audio generating apparatus has motion patterns of left and right directions, up and down directions, and clockwise and counterclockwise directions. In order to sense the three types of motion patterns, the motion-based audio generating apparatus includes one angular velocity or acceleration sensor in each of x, y, and z-axis directions of a body coordinate system thereof, respectively. The angular velocity or acceleration sensor disposed over the x-axis senses up and down motions of the motion-based audio generating apparatus and accelerations of the left and right motions. The angular velocity or acceleration sensor disposed over the y-axis senses clockwise and counterclockwise motions of the motion-based audio generating apparatus and accelerations of the forward and backward motions. The angular velocity or acceleration sensor disposed over the z-axis senses left and right motions of the motion-based audio generating apparatus and accelerations of the up and down motions.

Referring to FIG. 1 again, the motion pattern recognizer 20 includes an analog-to-digital converter (ADC) 22 which converts an analog voltage signal into a digital signal and a motion patter analyzer 24 which executes a motion pattern recognition algorithm for the motion-based audio generating apparatus. A sensor signal output from the sensor 10 is an analog signal corresponding to an angular velocity or acceleration value of the motion-based audio generating apparatus, and the ADC 22 converts the analog signal value output from the sensor 10 into a digital sensor signal value. The motion pattern analyzer 24 receives the digital sensor signal value and executes the motion pattern recognition algorithm to analyze the motion of the motion-based audio generating apparatus using the digital sensor signal value.

The audio signal generator 30 includes a storage medium 32 which stores the motion patterns of the motion-based audio generating apparatus and audio signal data corresponding to each of the motion patterns and a signal generator 34 which generates a signal corresponding to predetermined audio signal data. When the motion pattern analyzer 24 analyzes the motion patterns of the motion-based audio generating apparatus, the motion pattern analyzer 24 extracts the audio signal data corresponding to the motion patterns of the motion-based audio generating apparatus from the storage medium 32 and the signal generator 34 generates an audio signal corresponding to the extracted audio signal data. The output unit 40 receives the audio signal and outputs predetermined audio.

Figure 3:
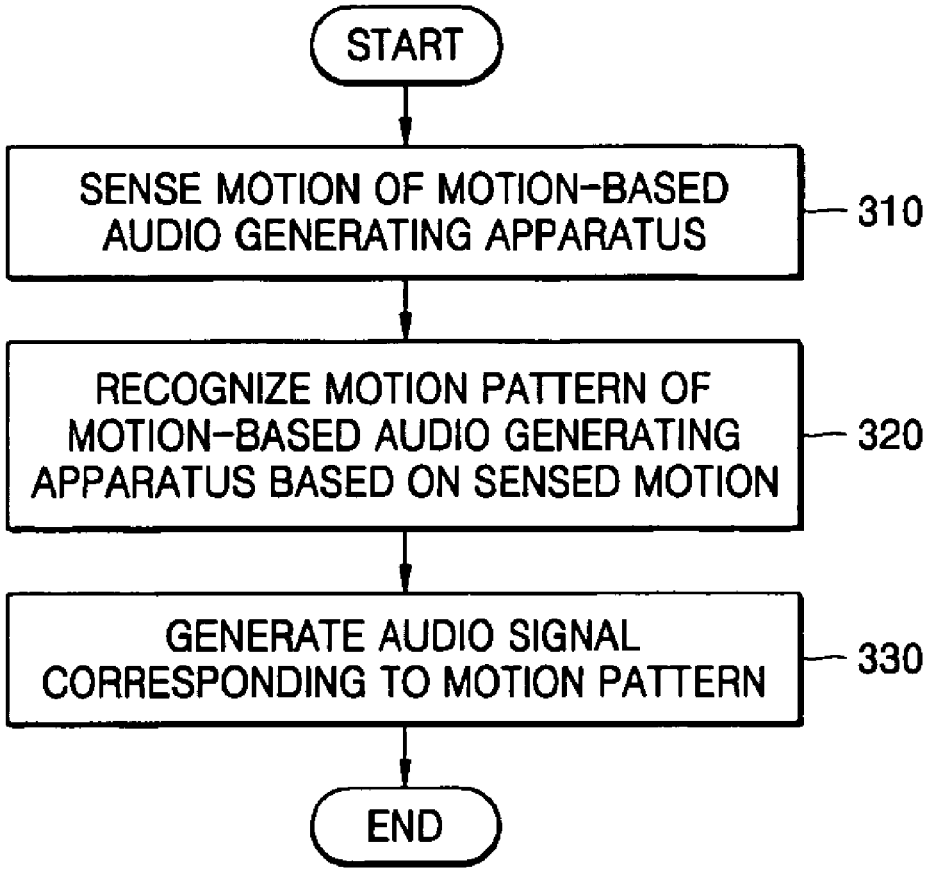
FIG. 3 is a flowchart for explaining a method of generating audio based on a motion of the motion-based audio generating apparatus of FIG. 1, according to an exemplary embodiment of the present invention.

FIG. 3 is a flowchart for explaining a method of generating audio based on the motion of the motion-based audio generating apparatus of FIG. 1, according to an exemplary embodiment of the present invention. Referring to FIG. 3, in operation 310, the sensor 10 of the motion-based audio generating apparatus senses the motion of the motion-based audio generating apparatus. As described above, the sensor 10 may include an angular velocity or acceleration sensor or a combination of the angular velocity and acceleration sensors which measure an angular velocity and acceleration of the motion-based audio generating apparatus, respectively. The sensor 10 generates a sensor signal value corresponding to the sensed motion of the motion-based audio generating apparatus and outputs the sensor signal value to the motion pattern recognizer 20. In operation 320, a motion pattern of the motion-based audio generating apparatus is recognized based on the motion of the motion-based audio generating apparatus. Operation 320 includes converting the sensor signal value into a digital sensor signal value via the ADC 22 and analyzing the motion pattern of the motion-based audio generating apparatus using the digital sensor signal value via the motion pattern recognizer 24. Analysis of the motion pattern of the motion-based audio generating apparatus will be explained in more detail with reference to FIGS. 4 and 5. In operation 330, an audio signal corresponding to the motion pattern of the motion-based audio generating apparatus is generated. Operation 330 includes extracting audio signal data corresponding to the motion pattern from the storage medium 32 and generating the audio signal based on the extracted audio signal data via the signal generator 34.

Figure 4:
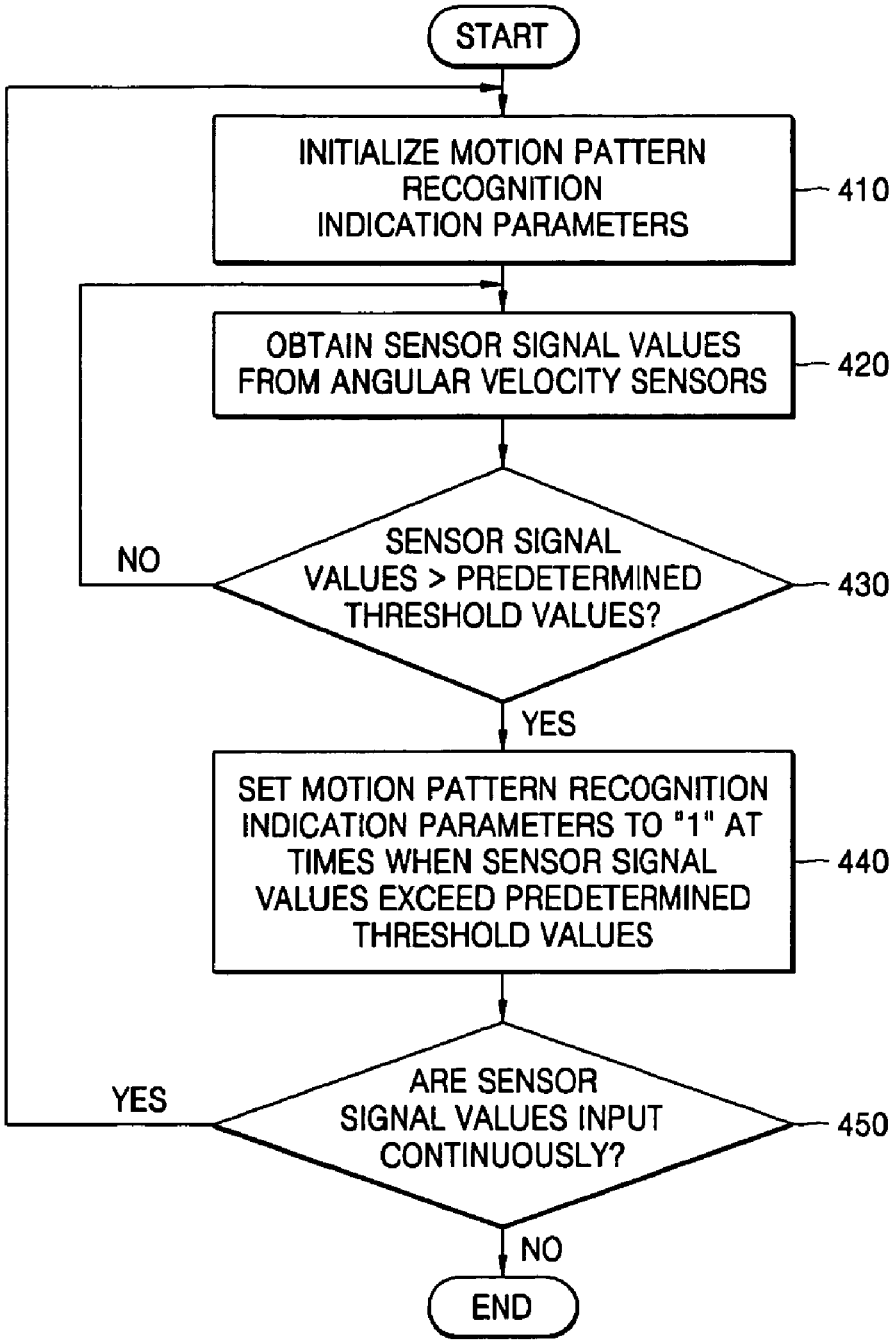
FIG. 4 is a flowchart for explaining analysis of a motion pattern of the motion-based audio generating apparatus of FIG. 1 including an angular velocity sensor, according to an exemplary embodiment of the present invention.

FIG. 4 is a flowchart for explaining analysis of the motion pattern of the motion-based audio generating apparatus of FIG. 1 including an angular velocity sensor, according to an exemplary embodiment of the present invention. In operation 410, three parameters $T_x$, $T_y$, and $T_z$ are set to "0". Here, the three parameters $T_x$, $T_y$, and $T_z$ are parameters for indicating whether a predetermined motion pattern of the motion-based audio generating apparatus is recognized. Hereinafter, the three parameters $T_x$, $T_y$, and $T_z$ are referred to as motion pattern recognition indication parameters. When the motion pattern recognition indication parameters $T_x$, $T_y$, and $T_z$ are set to "0", the motion pattern recognition indication parameters $T_x$, $T_y$, and $T_z$ indicate that a motion of the motion-based audio generating apparatus larger than a predetermined magnitude is not recognized. When the motion of the motion-based audio generating apparatus larger than the predetermined magnitude is recognized, the motion pattern recognition indication parameters $T_x$, $T_y$, and $T_z$ are set to "1". In operation 420, the digital sensor signal value is obtained via the ADC 22. The sensor 10 generates a measurement value corresponding to the motion magnitude of the motion-based audio generating apparatus, for example, a voltage signal. The measurement value is calculated as angular velocity sensor signal values $\omega_x$, $\omega_y$, and $\omega_z$ as follows in Equation 1:

$$\omega_x = S_x * (V_x - V_{0x})$$

$$\omega_y = S_y * (V_x - V_{0y})$$

$$\omega_z = S_z * (V_z - V_{0z}) \quad (1)$$

wherein $\omega_x$, $\omega_y$, and $\omega_z$ denote the angular velocity sensor signal values of the motion-based audio generating apparatus measured over x, y, and z axes of the body coordinate system of the motion-based audio generating apparatus, $S_x$, $S_y$, and $S_z$ denote sensitivities of the angular velocity sensors disposed over x, y, and z axes of the motion-based audio generating apparatus, $V_x$, $V_y$, and $V_z$ denote voltage signal values output from the angular velocity sensors disposed over x, y, and z axes of the motion-based audio generating apparatus, and $V_{ox}$, $V_{oy}$, and $V_{oz}$ denote zero rate bias values output when angular values of the angular velocity sensors disposed over x, y, and z axes of the motion-based audio generating apparatus are "0".

It can easily be understood by those of ordinary skill in the art that the motion pattern of the motion-based audio generating apparatus can be recognized using the measurement value generated by the angular velocity sensor instead of the angular velocity sensor signal values calculated as in Equation 1.

In operation 430, the digital sensor signal value is compared with predetermined threshold values $C_x$, $C_y$, and $C_z$ to detect when the digital sensor signal value exceeds the predetermined threshold values $C_x$, $C_y$, and $C_z$. The predetermined threshold values $C_x$, $C_y$, and $C_z$ are determined by analyzing the motion of a user. The predetermined threshold values $C_x$, $C_y$, and $C_z$ are set to be low when the motion of the user who generates predetermined audio is small. In contrast, the predetermined threshold values $C_x$, $C_y$, and $C_z$ are set to be high when the motion of the user who generates the predetermined audio is large. The predetermined threshold values $C_x$, $C_y$, and $C_z$ may be set to specific values in advance in the manufacture of the motion-based audio generating apparatus or may be adjusted as arbitrary values by a user according to the application field of the present invention or the user's intention. When the digital sensor signal value exceeds a predetermined threshold value, a specific motion pattern of the motion-based audio generating apparatus is recognized and the motion pattern recognition indication parameters $T_x$, $T_y$, and $T_z$ are set to "1". Up and down motions, left and right motions, or clockwise and counterclockwise motions of the motion-based audio generating apparatus are recognized using a motion pattern recognition algorithm which is described as follows.

(1) When the up and down motions of the motion-based audio generating apparatus are recognized, a time $k_x$ when $|\omega_x(k_x-1)| \leqq C_x$ is changed to $|\omega_x(k_x)| > C_x$ is detected. The changes of the up and down motions of the motion-based audio generating apparatus are recognized using the angular velocity sensor disposed over x-axis of the body coordinate system of the motion-based audio generating apparatus.

(2) When the left and right motions of the motion-based audio generating apparatus are recognized, a time $k_z$ when $|\omega_z(k_z-1)| \leqq C_z$ is changed to $|\omega_z(k_z)| > C_z$ is detected. The left and right motions of the motion-based audio generating apparatus are recognized using the angular velocity sensor disposed over z-axis of the body coordinate system of the motion-based audio generating apparatus.

(3) When the clockwise and counterclockwise motions of the motion-based audio generating apparatus are recognized, a time $k_y$ when $|\omega_y(k_y-1)| \leqq C_y$ is changed to $|\omega_y(k_y)| > C_y$ is detected. The clockwise and counterclockwise motions of the motion-based audio generating apparatus are recognized using the angular velocity sensor disposed over y-axis of the body coordinate system of the motion-based audio generating apparatus. Here, $\omega_x$, $\omega_y$, and $\omega_z$ are the sensor signal values output from the angular velocity sensors, $k_x$, $k_y$, and $k_z$ are current discrete time values, and $k_x-1$, $k_y-1$, and $k_z-1$ are values right before current discrete times.

In operation 440, the motion pattern recognition indication parameters $T_x$, $T_y$, and $T_z$ are set to "1" at the times $k_x$, $k_y$, and $k_z$ when the sensor signal values output from the angular velocity sensors exceed the predetermined threshold values $C_x$, $C_y$, and $C_z$, respectively. The motion-based audio generating apparatus generates audio respectively corresponding to motion patterns of the motion-based audio generating apparatus in x, y, and z axis directions when the motion pattern recognition indication parameters $T_x$, $T_y$, and $T_z$ are set to "1". In operation 450, a determination is made as to whether the sensor signal values output from the angular velocity sensors are continuously input. When the sensor signal values are obtained, the process returns to operation 410.

If in operation 430, the digital sensor signal value generated by the angular velocity sensor does not exceed the predetermined threshold values $C_x$, $C_y$, and $C_z$, the process returns to operation 420.

In the above-described operations (1), (2), and (3) of the motion pattern recognition algorithm for analyzing the motion pattern of the motion-based audio generating apparatus, the motion pattern of the motion-based audio generating apparatus is recognized using an absolute value of the digital sensor signal value generated by the angular velocity sensor. Thus, the left and right motions, the up and down motions, or clockwise and counterclockwise motions are identically recognized. However, the motion pattern recognition algorithm for the motion-based audio generating apparatus may be performed without using the absolute value. In this case, the angular velocity sensor disposed over x-axis of the body coordinate system of the motion-based audio generating apparatus may distinguish the up and down motions of the motion-based audio generating apparatus. The angular velocity sensor disposed over y-axis may distinguish the clockwise and counterclockwise motions of the motion-based audio generating apparatus. The angular velocity sensor disposed over z-axis may distinguish the left and right motions of the motion-based audio generating apparatus.

Figure 5:
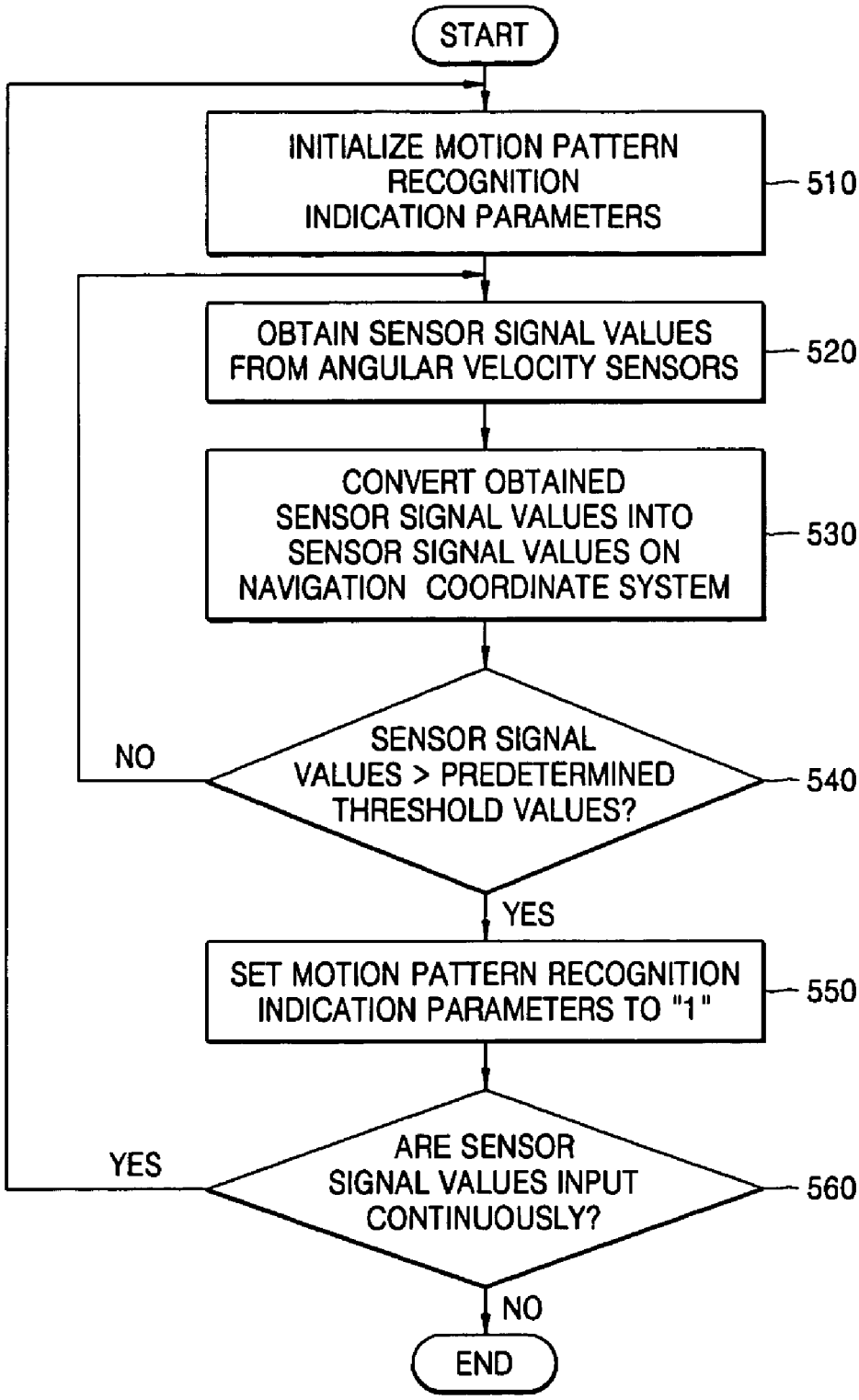
FIG. 5 is a flowchart for explaining analysis of a motion pattern of the motion-based audio generating apparatus of FIG. 1 including an acceleration sensor, according to an exemplary embodiment of the present invention.

FIG. 5 is a flowchart for explaining analysis of the motion pattern of the motion-based audio generating apparatus of FIG. 1 including an acceleration sensor, according to an exemplary embodiment of the present invention. Referring to FIG. 5, in operation 510, the motion pattern recognition indication parameters $T_x$, $T_y$, and $T_z$ of the motion-based audio generating apparatus are initialized to "0". The definition of the motion pattern recognition indication parameters $T_x$, $T_y$, and $T_z$ is as described with reference to FIG. 4. In operation 520, digital sensor signal values $A_{bx}$, $A_{by}$, and $A_{bz}$ are obtained via the ADC 22. The sensor 10 generates a measurement value corresponding to the motion magnitude of the motion-based audio generating apparatus, for example, a voltage signal. The measurement value is calculated as acceleration sensor signal values $A_{bx}$, $A_{by}$, and $A_{bz}$ as in Equation 2:

$$A_{bx}=S_{bx}*(V_{bx}-V_{b0x})$$

$$A_{by}=S_{by}*(V_{by}-V_{b0y})$$

$$A_{bz}=S_{bz}*(V_{bz}-V_{b0z}) \quad (2)$$

wherein $A_{bx}$, $A_{by}$, and $A_{bz}$ denote the acceleration sensor signal values of the motion-based audio generating apparatus measured over x, y, and z axes of the body coordinate system of the motion-based audio generating apparatus, $S_{bx}$, $S_{by}$, and $S_{bz}$ denote sensitivities of acceleration sensors disposed over x, y, and z axes of the motion-based audio generating apparatus, $V_{bx}$, $V_{by}$, and $V_{bz}$ denote measurement values generated by the acceleration sensors disposed over x, y, and z axes of the body coordinate system of the motion-based audio generating apparatus, and $V_{box}$, $V_{boy}$, and $V_{boz}$ denote measurement values generated when acceleration values of the acceleration sensors disposed over x, y, and z axes of the body coordinate system of the motion-based audio generating apparatus are "0".

Since the motion-based audio generating apparatus is always effected by acceleration of gravity g, in operation 530, the acceleration sensor signal values $A_{bx}$, $A_{by}$, and $A_{bz}$ generated by the acceleration sensors must be converted into sensor signal values $A_{nx}$, $A_{ny}$, and $A_{nz}$ of a navigation coordinate system. In general, an angular velocity sensor is required to convert a sensor signal value of the body coordinate system into a sensor signal value of the navigation coordinate system. However, in the present invention, on the assumption that the motion of the motion-based audio generating apparatus does not greatly vary when a user moves the motion-based audio generating apparatus, the sensor signal values $A_{bx}$, $A_{by}$, and $A_{bz}$ of the body coordinate system are converted into the sensor signal values $A_{nx}$, $A_{ny}$, and $A_{nz}$ of the navigation coordinate system using Equation 3:

$$C_b^n = \begin{bmatrix} \cos\psi\cos\theta & -\sin\psi\cos\phi+\cos\psi\sin\theta\sin\phi & \sin\psi\sin\phi+\cos\psi\sin\theta\cos\phi \\ \sin\psi\cos\phi & \cos\psi\cos\phi+\sin\psi\sin\theta\sin\phi & -\cos\psi\sin\phi+\sin\psi\sin\theta\cos\phi \\ -\sin\theta & \cos\theta\sin\phi & \cos\theta\cos\phi \end{bmatrix} \quad (3)$$

$$\begin{bmatrix} A_{bx} \\ A_{by} \\ A_{bz} \end{bmatrix} = C_b^n \begin{bmatrix} A_{bx} \\ A_{by} \\ A_{bz} \end{bmatrix} - \begin{bmatrix} 0 \\ 0 \\ -g \end{bmatrix}$$

wherein g denotes acceleration of gravity, $C_b^n$ denotes a rotation matrix, and $\phi$, $\theta$, and $\psi$ denote Euler's angles which are calculated as follows in Equations 4, 5, and 6:

$$\phi(t) = \tan^{-1}\left(\frac{A_{by}(0)}{A_{bx}}\right) \quad (4)$$

$$\theta(t) = \sin^{-1}\left(\frac{A_{by}(0)}{g}\right), \text{ or } \theta(t) = \tan^{-1}\left(\frac{A_{bx}(0)}{A_{by}^2+A_{bx}^2}\right) \quad (5)$$

$$\psi(t) = 0 \quad (6)$$

In operation 540, the sensor signal values $A_{nx}$, $A_{ny}$, and $A_{nz}$ of the navigation coordinate system are compared with predetermined threshold values $C_{bx}$, $C_{by}$, and $C_{bz}$ to detect times when the sensor signal values $A_{nx}$, $A_{ny}$, and $A_{xz}$, exceed the predetermined threshold values $C_{bx}$, $C_{by}$, and $C_{bz}$. Acceleration of the motion-based audio generating apparatus in a specific direction is recognized when the sensor signal values $A_{nx}$, $A_{ny}$, and $A_{nz}$ exceed the predetermined threshold values $C_{bx}$, $C_{by}$, and $C_{bz}$. Accelerations of the motion-based audio generating apparatus in up and down directions, the left and right directions, or forward and backward directions are recognized as follows.

(1) When the accelerations of the motion-based audio generating apparatus in the up and down directions are recognized, a time $k_z$ when $|A_{nz}(k_z-1)|\leqq C_{bz}$ is changed to $|A_{nz}(k_z)|>C_{bz}$ is detected. The accelerations of the motion-based audio generating apparatus in the up and down directions are recognized using the acceleration sensor disposed over z-axis of the body coordinate system of the motion-based audio generating apparatus.

(2) When the accelerations of the motion-based audio generating apparatus in the left and right directions are recognized, a time $k_x$ when $|A_{nx}(k_x-1)|\leqq C_{bx}$ is changed to $|A_{nx}(k_x)|>C_{bx}$ is detected. The accelerations of the motion-based audio generating apparatus in the left and right directions are recognized using the acceleration sensor disposed over x-axis of the body coordinate system of the motion-based audio generating apparatus.

(3) When the accelerations of the motion-based audio generating apparatus in the forward and backward directions are recognized, a time $k_y$ when $|A_{ny}(k_y-1)|\leqq C_{by}$ is changed to $|A_{ny}(k_y)|>C_{by}$ is detected. The accelerations of the motion-based audio generating apparatus in the forward and backward directions are recognized using the acceleration sensor disposed over y-axis of the body coordinate system of the motion-based audio generating apparatus. Here, $k_x$, $k_y$, and $k_z$ are current discrete time values, and $k_x-1$, $k_y-1$, and $k_z-1$ are values right before current discrete times. In operation 550, the motion pattern recognition indication parameters $T_x$, $T_y$, and $T_z$ are set to "1" at the times $K_x$, $K_y$, and $K_z$ when the sensor signal values output from the acceleration sensors exceed the predetermined threshold values $C_{bx}$, $C_{by}$, and $C_{bz}$. The motion-based audio generating apparatus generates audio respectively corresponding to motion patterns over x, y, and z axes when the motion pattern recognition indication parameters $T_x$, $T_y$, and $T_z$ are set to "1".

If in operation 540, the sensor signal values $A_{nx}$, $A_{ny}$, and $A_{nz}$ of the navigation coordinate system do not exceed the predetermined threshold values $C_{bx}$, $C_{by}$, and $C_{bz}$, the process returns to operation 520. In operation 560, a determination is made as to whether the sensor signal values are continuously input from the acceleration sensors. If in operation 560, it is determined that the sensor signal values are continuously inputted from the acceleration sensors, the process returns to operation 510.

Figure 6A:
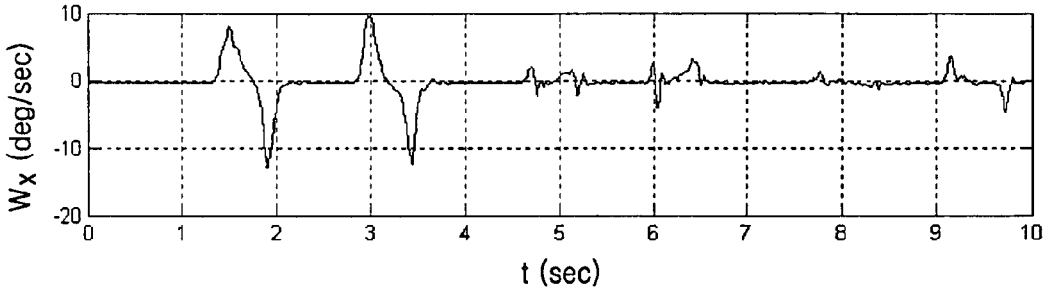
FIGS. 6A, 6B and 6C are views showing angular velocity sensor signal values $\omega_x$, 107 $_y$, and $\omega_z$ of x, y, and z axes of a body coordinate system generated from the angular velocity sensor of the motion-based audio generating apparatus of FIG. 1 when the motion-based audio generating apparatus including the angular velocity sensor moves to the left and right, up and down, or clockwise and counterclockwise.
Figure 6B:
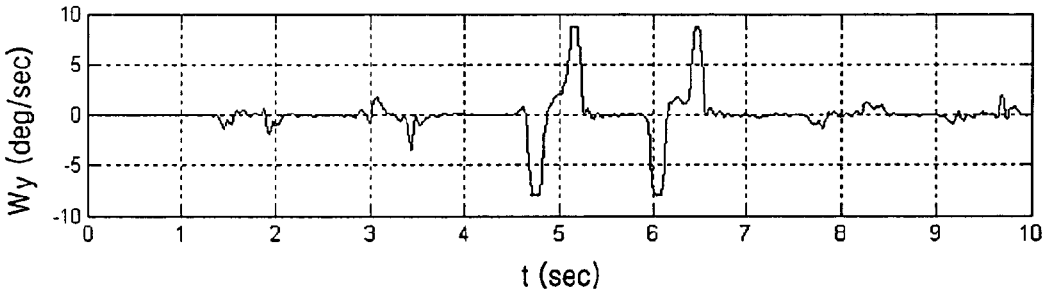
Figure 6C:
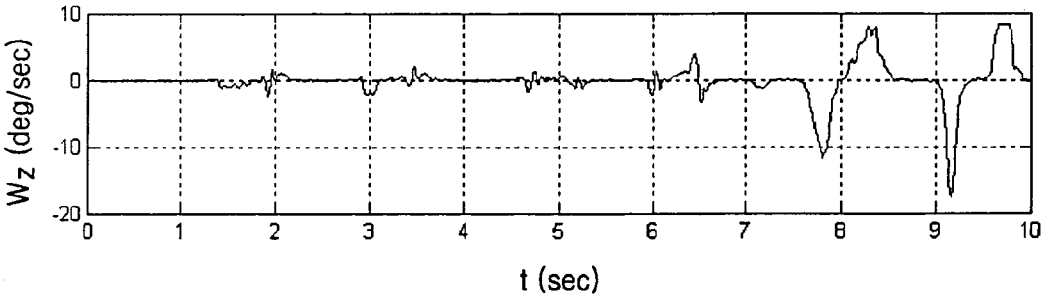

FIGS. 6A, 6B and 6*c* are views showing angular velocity sensor signal values $\omega_x$, $\omega_y$ and $\omega_z$ of axes of the body coordinate system generated from the angular velocity sensor of the motion-based audio generating apparatus of FIG. 1 when the motion-based audio generating apparatus including the angular velocity sensor moves to the left and right, up and down, or clockwise and counterclockwise. FIG. 6A shows the angular velocity sensor signal value $\omega_x$ over x-axis, FIG. 6B shows the angular velocity sensor signal value $\omega_y$ over y-axis, and FIG. 6C shows the angular velocity sensor signal value $\omega_z$ over z-axis.

Figure 7A:
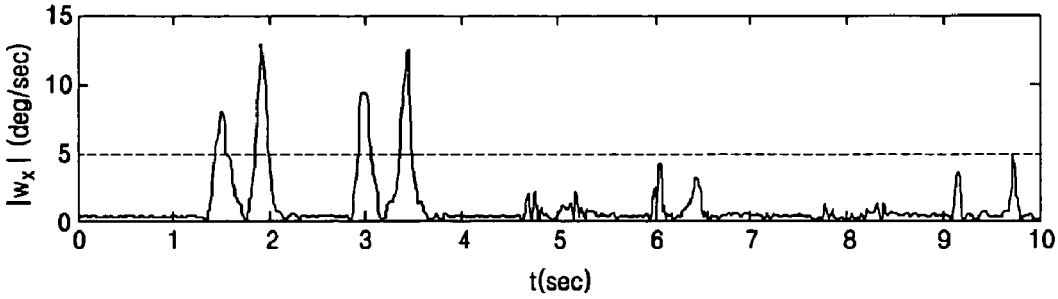
FIGS. 7A, 7B and 7C are views showing absolute values $|\omega_x|$, $|\omega_y|$, and $|\omega_z|$ of the angular velocity sensor signal values $\omega_x$, $\omega_y$, and $\omega_z$ of FIGS. 6A, 6B and 6C and predetermined threshold values $C_x$, $C_y$, and $C_z$ determined by analyzing a motion of a user.
Figure 7B:
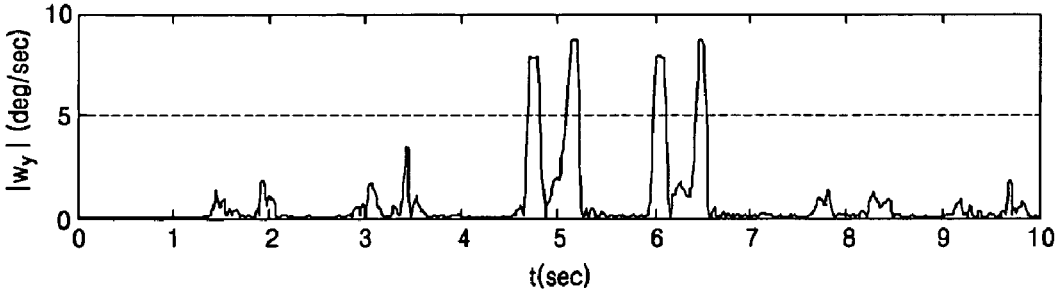
Figure 7C:
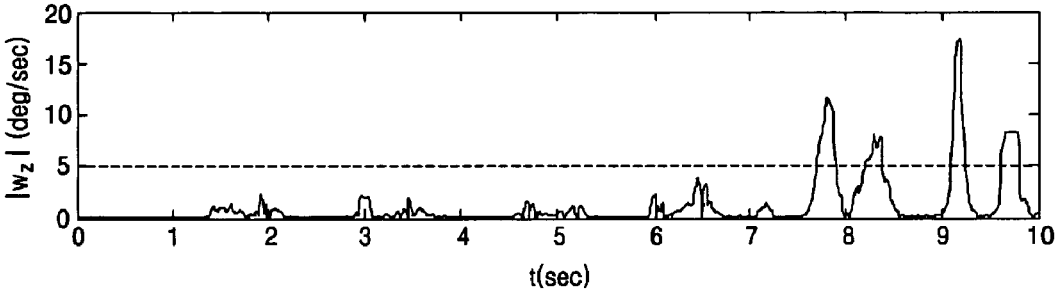

FIGS. 7A, 7B and 7C are views showing absolute values $|\omega_x|$, $|\omega_y|$, and $|\omega_z|$ of the angular velocity sensor signal values $\omega_x$, $\omega_y$, and $\omega_z$ of FIGS. 6A, 6B, and 6C and the predetermined threshold values $C_x$, $C_y$ and $C_z$ determined by analyzing the motion pattern of the user. FIG. 7A shows the absolute value $|\omega_x|$ of the angular velocity sensor signal value $\omega_x$ over x-axis and the threshold value $C_x$, FIG. 7B shows the absolute value $|\omega_y|$ of the angular velocity sensor signal value $\omega_y$ over y-axis and the threshold value $C_y$, and FIG. 7C shows the absolute value $|\omega_z|$ of the angular velocity sensor signal value $\omega_z$ over z-axis and the threshold value $C_z$. In FIG. 7A, the absolute value $|\omega_x|$ of the angular velocity sensor signal value $\omega_x$ over x-axis exceeds the threshold value $C_x$, at four discrete times. In FIG. 7B, the absolute value $|\omega_y|$ of the angular velocity sensor signal value $\omega_y$ over y-axis exceeds the threshold value $C_y$ at four discrete times. In FIG. 7C, the absolute value $|\omega_z|$ of the angular velocity sensor signal value $\omega_z$ over z-axis exceeds the threshold value $C_z$ at four discrete times.

Figure 8A:
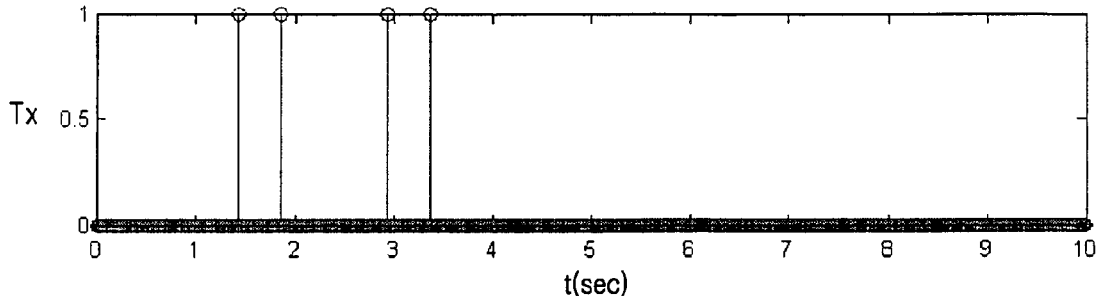
FIGS. 8A, 8B and 8C are views showing discrete times when motion pattern recognition indication parameters $T_x$, $T_y$, and $T_z$ are set to "1" using a motion pattern recognition algorithm.
Figure 8B:
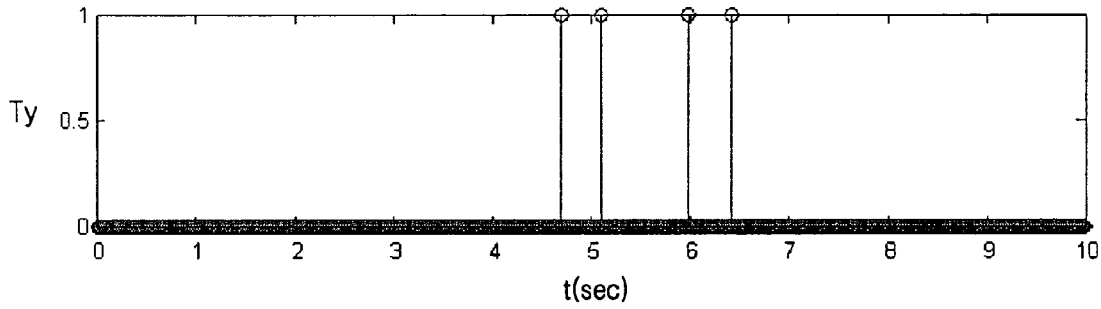
Figure 8C:
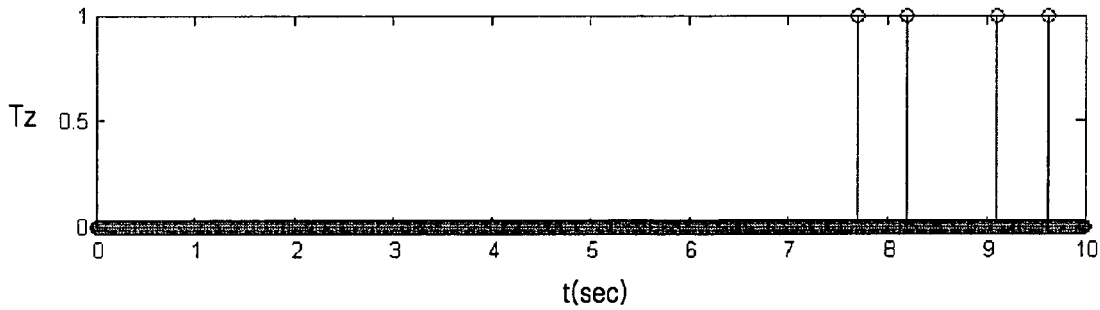

FIGS. 8A, 8B and 8C are views showing discrete times when the motion pattern recognition indication parameters $T_x$, $T_y$, and $T_z$ are set to "1". FIG. 8A shows discrete times at which the absolute value $|\omega_x|$ of the angular velocity sensor signal value $\omega_x$ over x-axis exceeds the threshold value $C_x$. FIG. 8B shows discrete times at which the absolute value $|\omega_y|$ of the angular velocity sensor signal value $\omega_y$ over y-axis exceeds the threshold value $C_y$. FIG. 8C shows discrete times at which the absolute value $|\omega_z|$ of the angular velocity sensor signal value $\omega_z$ over z-axis exceeds the threshold value $C_z$. The motion pattern recognition indication parameters $T_x$, $T_y$, and $T_z$ are set to "1" when absolute values of angular velocity sensor signal values exceed predetermined threshold values over x, y, and z-axes.

Figure 9:
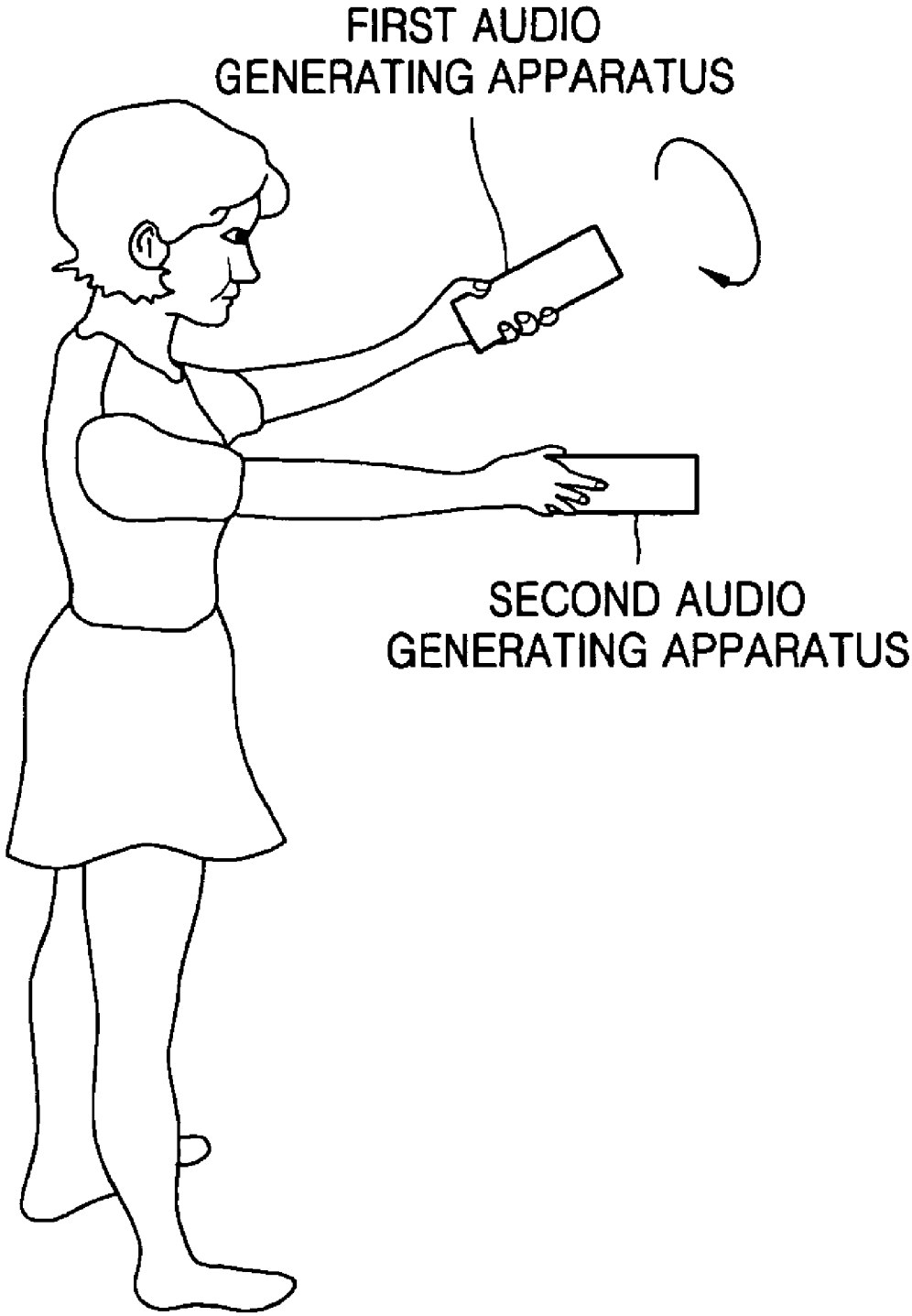
FIG. 9 is a view for showing an embodiment of realizing bit box using two audio generating apparatuses for generating different types of audio.

FIG. 9 is a view for showing an exemplary embodiment of realizing bit box using two audio generating apparatuses for generating different types of audio. As shown in FIG. 9, when a user moves first and second audio generating apparatuses to the left and right, up and down, or clockwise and counterclockwise or at a fast or slow velocity, the first and second audio generating apparatuses sense their motions, and then the first and second audio generating apparatuses recognize their motion patterns based on the sensed motions. The first and second audio generating apparatuses sense their motion patterns and then generate audio corresponding to the motion patterns. The first and second audio generating apparatuses may be manufactured so as to generate different types of audio according to motion patterns. FIG. 9 shows an exemplary embodiment of audio generating apparatuses. However, a plurality of audio generating apparatuses may be used according to the usage field of audio generating apparatuses and may be manufactured so as to generate different types of audio according to their motion patterns.

As described above, in a motion-based audio generating apparatus and method, according to the present invention, a user can check during input of a specific character, signal, or control command what kind of character, signal, or control command is inputted. Also, the present invention can be applied to various portable information devices such as a personal digital assistant (PDA) or devices having a percussion instrument function. As a result, a specific motion of the user can be expressed as audio, which contributes to satisfying modern consumers' desires.

The exemplary embodiments of the present invention can be written as computer programs and can be implemented in general-use digital computers that execute the programs using a computer readable recording medium. Examples of the computer readable recording medium include magnetic storage media (e.g., ROM, floppy disks, hard disks, etc.), optical recording media (e.g., CD-ROMs, or DVDs), and storage media such as carrier waves (e.g., transmission through the Internet).

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An audio generating apparatus comprising:

a sensor which senses a motion of an apparatus and generates a sensor signal corresponding to the motion which is sensed;

a motion pattern recognizer which recognizes a motion pattern of the apparatus in a three-dimensional space based on the sensor signal; and an audio signal generator which generates an audio signal based on the motion pattern;

wherein the motion pattern recognizer recognizes the motion pattern by initializing a motion pattern recognition indication parameter which indicates the motion pattern in the three-dimensional space, detecting whether the sensor signal exceeds a predetermined threshold value, and setting the motion pattern recognition indication parameter to a predetermined value if it is detected that the sensor signal exceeds the predetermined threshold value; and wherein the motion pattern recognition indication parameter is set to the predetermined value at discrete times when absolute values of angular velocity sensor signals exceed the predetermined threshold value.

2. The audio generating apparatus of claim 1, wherein the motion pattern recognizer comprises:

an analog-to-digital converter which converts the sensor signal into a digital sensor signal; and a motion pattern analyzer which analyzes the motion pattern of the apparatus based on the digital sensor signal.

3. The audio generating apparatus of claim 1, wherein the audio signal generator comprises:

a storage medium which stores motion patterns of the apparatus and audio signal data corresponding to the motion patterns; and a signal generator which extracts the audio signal data from the storage medium to generate the audio signal.

4. The audio generating apparatus of claim 1, further comprising an output unit which outputs the audio signal.

5. The audio generating apparatus of claim 1, wherein the sensor comprises an angular velocity sensor.

6. The audio generating apparatus of claim 1, wherein the sensor comprises an acceleration sensor.

7. The audio generating apparatus of claim 1, wherein the sensor comprises an angular velocity sensor and an acceleration sensor.

8. An audio generating method comprising:

sensing a motion of an apparatus and generating a sensor signal corresponding to the motion which is sensed;

recognizing a motion pattern of the predetermined apparatus in a three-dimensional space based on the sensor signal; and generating an audio signal corresponding to the motion pattern;

wherein recognizing the motion pattern comprises:

converting the sensor signal into a digital sensor signal; and analyzing the motion pattern of the apparatus based on the digital sensor signal, and wherein analyzing the motion pattern comprises:

initializing a motion pattern recognition indication parameter which indicates the motion pattern in the three-dimensional space;

detecting whether the sensor signal exceeds a predetermined threshold value; and setting the motion pattern recognition indication parameter to a predetermined value if it is detected that the sensor signal exceeds the predetermined threshold value;

wherein the motion pattern recognition indication parameter is set to the predetermined value at discrete times when absolute values of angular velocity sensor signals exceed the predetermined threshold value.

9. The audio generating method of claim 8, wherein the threshold value can be controlled according to an input by a user.

10. The motion-based audio generating method of claim 8, wherein analyzing the motion pattern comprises:

initializing a motion pattern recognition indication parameter;

converting the digital sensor signal value into a sensor signal value on a navigation coordinate system;

detecting whether the sensor signal value exceeds a predetermined threshold value; and converting the motion pattern recognition indication parameter to a predetermined value if it is detected that the sensor signal value exceeds the predetermined threshold value.

11. The audio generating method of claim 10, wherein the predetermined threshold value can be controlled according to an input by a user.

12. The audio generating method of claim 8, wherein the generating the audio signal comprises:

extracting audio signal data corresponding to the motion pattern; and generating the audio signal corresponding to the audio signal data.

13. The audio generating method of claim 8, further comprising outputting the audio signal.

14. The audio generating method of claim 8, wherein the sensing the motion of the apparatus comprises sensing an angular velocity of the apparatus.

15. The audio generating method of claim 8, wherein the sensing the motion of the apparatus comprises sensing an acceleration of the apparatus.

16. The audio generating method of claim 8, wherein the sensing the motion of the apparatus comprises sensing an angular velocity and an acceleration of the apparatus.

17. A computer-readable recording medium on which a program is recorded to execute an audio generating method in a computer, the method comprising:

sensing a motion of an apparatus and generating a sensor signal corresponding to the motion which is sensed;

recognizing a motion pattern of the predetermined apparatus in a three dimensional space based on the sensor signal; and generating an audio signal corresponding to the motion pattern;

wherein the recognizing the motion pattern comprises:

converting the sensor signal into a digital sensor signal; and analyzing the motion pattern of the apparatus based on the digital sensor signal, and wherein analyzing the motion pattern comprises:

initializing a motion pattern recognition indication parameter which indicates the motion pattern in the three-dimensional space;

detecting whether the sensor signal exceeds a predetermined threshold value; and setting the motion pattern recognition indication parameter to a predetermined value if it is detected that the sensor signal exceeds the predetermined threshold value;

wherein the motion pattern recognition indication parameter is set to the predetermined value at discrete times when absolute values of angular velocity sensor signals exceed the predetermined threshold value.

* * * * *